United States Patent [19]

Laptev et al.

[11] 4,351,489

[45] Sep. 28, 1982

[54] REFINER DISK

[76] Inventors: Lev N. Laptev, Institutsky prospekt. 9, kv. 30; Sergei S. Legotsky, Institutsky prospekt, 9, kv. 18, both of Leningrad; Viadimir A. Semenovsky, ulitsa Promyshlennaya, 1, kv. 3, Karelskaya ASSR, Kondopoga; Sergei S. Sambursky, ulitsa Kilbi, 8, kv. 24, Tallin; Abram B. Litvinov, ultisa Anokhina, 35, kv. 18; Alexei I. Kondrashov, ulitsa Meretskova, 9, kv. 50, both of Petrozavodsk, all of U.S.S.R.

[21] Appl. No.: 108,527

[22] Filed: Dec. 31, 1979

Related U.S. Application Data

[63] Continuation of Ser. No. 917,677, Jun. 21, 1978, abandoned.

[51] Int. Cl.[3] ..... B02C 7/12

[52] U.S. Cl. ..... 241/261.3; 241/298

[58] Field of Search ..... 241/261.2, 261.3, 298

[56] References Cited

U.S. PATENT DOCUMENTS

| | | | |
|---|---|---|---|
| Re. 4,739 | 2/1872 | Burr | 241/261.3 |
| 705,410 | 7/1902 | Jorgensen | 241/298 |
| 3,117,603 | 1/1964 | Van Keuren et al. | 241/298 |
| 3,128,055 | 4/1964 | Michel | 241/298 |
| 3,149,792 | 9/1964 | Textor | 241/261.3 |
| 3,459,379 | 8/1969 | Brown | 241/298 X |
| 3,910,511 | 10/1975 | Leider et al. | 241/298 X |
| 4,005,827 | 2/1977 | Frair et al. | 241/261.3 |
| 4,039,153 | 8/1977 | Hoffman | 241/261.2 |

FOREIGN PATENT DOCUMENTS

| | | | |
|---|---|---|---|
| 430729 | 9/1933 | United Kingdom | 241/298 |
| 502993 | 1/1974 | U.S.S.R. . | |

*Primary Examiner*—Howard N. Goldberg

*Attorney, Agent, or Firm*—McAulay, Fields, Fisher, Goldstein & Nissen

[57] ABSTRACT

A refiner disk comprises a base supporting a combined metal-ceramic refining plate secured thereto and formed by a plurality of metallic sectors and ceramic-based abrasive sectors, said sectors being arranged alternately. The proposed disk produces improved pulped fibre products with less expenditure of energy.

4 Claims, 5 Drawing Figures

REFINER DISK

This is a continuation of application Ser. No. 917,677 filed June 21, 1978, now abandoned.

The present invention relates to attrition mills, and particularly to refiner discs which are particularly advantageous for use in manfacturing paper.

BACKGROUND OF THE INVENTION

To manufacture a high quality paper, a great variety of attrition mills are used to refine the cellulosic pulp, the double disc pulp refiners being most extensively utilized.

The key components of known disc refiners are two coaxially arranged discs, their opposed operating surfaces being used to refine material passing therebetween. Widely used are dowble disc refiners having one disc held stationary and called a stator, and its other disc rotatably mounted and called a rotor. Each of the discs, the stator and the rotor, is formed by two parts, namely a base and a refining plate secured thereto. In most cases the refining plate is shaped like a metallic disc having refining bars mounted thereon and spaced to form channels therebetween.

The most general requirements imposed upon the refining process of the cellulosic pulp used for manufacture of paper possessing high mechanical strength, are to produce pulp products consisting of flexible and plastic fibres with maximum active surfaces, and to minimize the possibility of cutting the fibres. Moreover, the treated fibres must be napped that can be achieved by multiple brushing action of the refining plate upon the fibres.

It is difficult, however, to meet the requirements mentioned above, when using the refiner disc having a metallic refining plate, since the latter produces a considerable cutting action upon the fibres. In this case, the fibres are cut short without brushing and splitting and fall to reach the desired flexibility and plasticity. Manufactured from such a fibre product, the paper has loosely bound fibres that decrease its mechanical strength. The metallic refining plates exert a particular adverse effect when refining short-fibred wood chips since short-cutting of such fibres substantially decreases the paper's mechanical strength.

Known in the art are the discs having a refining plate made from sintered metal. A microporous structure of sintered metal permits the fibres to be brushed more intensively. The manufacture of the refining plate from a sintered metal is a very time-consuming operation, and said discs are not of wide application. The most common disadvantage of the discs provided with metallic refining plates is a high noise level arising from continuous interactions between the metallic plates of the rotor and the stator during the refining process.

There are also known refiners provided with two discs, namely the rotor having a metallic refining plate and the ceramic stator having its operating surface made from abrasive material which has an improved capability of brushing the fibres.

Rotor to stator clearance being negligible, the discs are repeatedly brought into contact during the refining operation, which results in rapid wear of the metallic refining plate of the rotor due to its contact with the abrasive surface of the stator, thus generating a need for often renewing the worn parts.

Also known is a refining disc having a refining plate comprising sections made from metal and ceramics (of. USSR Inventor's Certificate No. 502,993), which comprises a base supporting a combined metalceramic refining plate. The refining plate consists of a central metallic ring provided with refining bars and a peripheral ring made from ceramic-based abrasive material.

Such a disc is of limited utility since it is difficult to manufacture a ceramic-based abrasive ring of large diameter. Moreover, the peripherally arranged ring made from ceramic-based abrasive material hinders the pulp passing, thus decreasing the refiner output with simultaneous increase in the expenditure of energy.

SUMMARY OF THE INVENTION

It is an object of the present invention to provide a refiner disc having a capability of high quality refining the cellulosic pulp with minimum expenditure of energy.

Another object of the present invention is to provide a long-lived refiner disc.

A further object of the present invention is to provide a refiner disc ensuring a low noise level during the refiner operation.

With these and other objects in view, there is proposed a refiner disc comprising a base and a metal-ceramic refining plate secured thereto, wherein, according to the invention the metal-ceramic refining plate is made with a plurality of metallic sectors and ceramic-based abrasive sectors, said sectors being alternatively arranged.

The refining plate of the present invention ensures a high quality refining of the cellulosic pulp thanks to the abrasive sectors of the refining plate, and permits the expenditure of energy to be decreased by permitting the pulp to pass more freely between the abrasive operating surfaces.

Moreover, the refining plate of the present invention has a prolonged life time due to a decreased wear of the metallic sectors interacting with the ceramic-based abrasive sectors of the opposed disc.

This results from the fact that the alternating sectors are mounted on the supporting base so that the operating surfaces of the metallic sectors are exactly level with the operating surfaces of the ceramic-based abrasive sectors. Therefore, in case of sporadic impacts between the opposed operating surfaces of the discs, the ceramic-based abrasive sectors gives rise only to a slight abrasive action upon the metallic sectors of the opposed discs, the surfaces of the sectors made of metal, preventing the severe wear of the operating surfaces.

Furthermore, the proposed discs have in operation a lower noise level as compared to known discs with all-metal refining plate.

It is advisable that the operating surface of the ceramic-based abrasive sectors be provided with a plurality of channels disposed at an angle to corresponding radii of the disc, the angle ranging from near 0 to 90 degrees. The value of the angle affects the quality of fibre products as well as the refiner through-put.

The channels being disposed parallel to the corresponding radii of the disc, i.e. at an angle equal or near the zero, provide maximum through-put of the refiner and hence the minimum expeditures of energy are obtained. Such an arrangement of the channels, however, causes severe cutting action of the edges of the channels by the action of the ceramic-based abrasive sectors upon the cellulosic pulp being treated, resulting in adverse short-cutting of fibres.

As mentioned hereinabove, the paper manufactured from such a short fibre product possesses low mechanical strength.

On the other hand, by arranging the channels perpendicular to the corresponding radii of the disc, the maximum brushing effect upon the cellulosic pulp is achieved, which, in turn, ensures the fibres to be of increased length and plasticity, thus contributing to the manufacture of a high quality paper. In this case, however, the refiner consumes more energy because of its lower through-put.

Thus, the angle between the channels and the corresponding radii of the ceramic-based abrasive sector can be varied within the range from 0 to 90 degrees, depending upon the required quality of fibre product and the expenditure of energy.

Other and further objects are advantages of the invention will be apparent to those skilled in the art from the following detailed description of the preferred embodiments thereof taken in conjunction with the accompanying drawings, wherein:

DETAILED DESCRIPTION OF THE INVENTION

Figure 1:
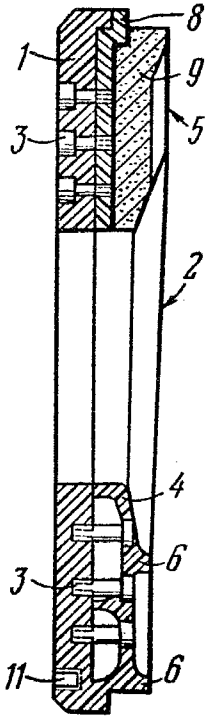
FIG. 1 is a cross-sectional view of a refiner disc, in accordance with the present invention.

Referring now to FIG. 1, the refiner disc comprises a base 1 supporting a refining plate 2 secured thereto by screws 3.

The refining plate 2 consists of metallic sectors 4 and ceramic-based abrasive sectors 5 arranged atlernatively (FIGS. 1 through 4). The metallic sectors 4 are provided with projecting refining bars 6 spaced to form channels 7. The sectors 5 have a metallic backing 8, a ceramic-based abrasive layer 9 being attached thereto with an adhesive not shown, e.g. epoxy adhesive.

The surface of the base 1, opposing the refining plate 2 is provided with threaded bores 11 to secure the refining disc to a bearing disc (not shown) of the refiner (not shown).

Figure 3:
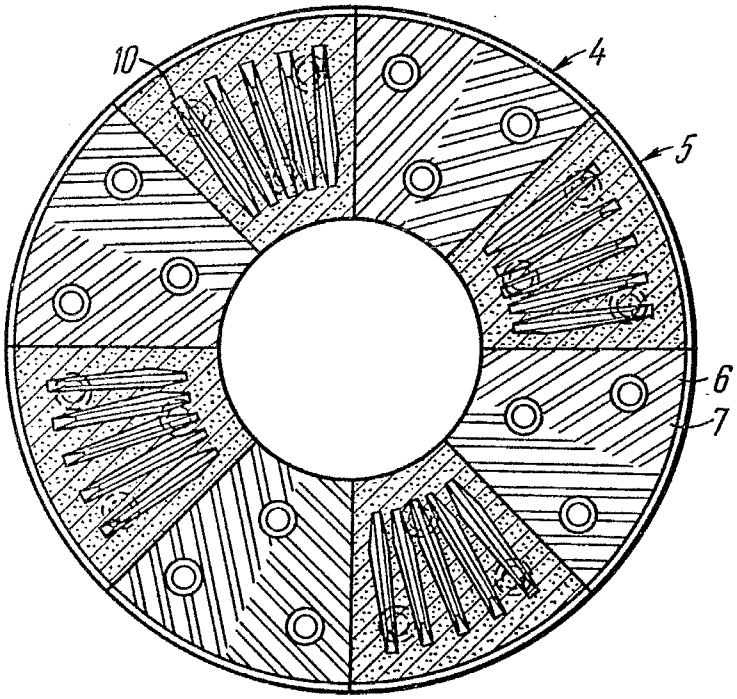
FIG. 3 is an embodiment of a refiner disc having channels disposed on the ceramic-based abrasive sectors.
Figure 4:
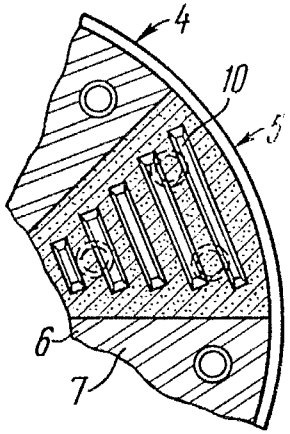
FIG. 4 is another embodiment of a refiner disc having channels extending perpendicularly to disc radii.
Figure 2:
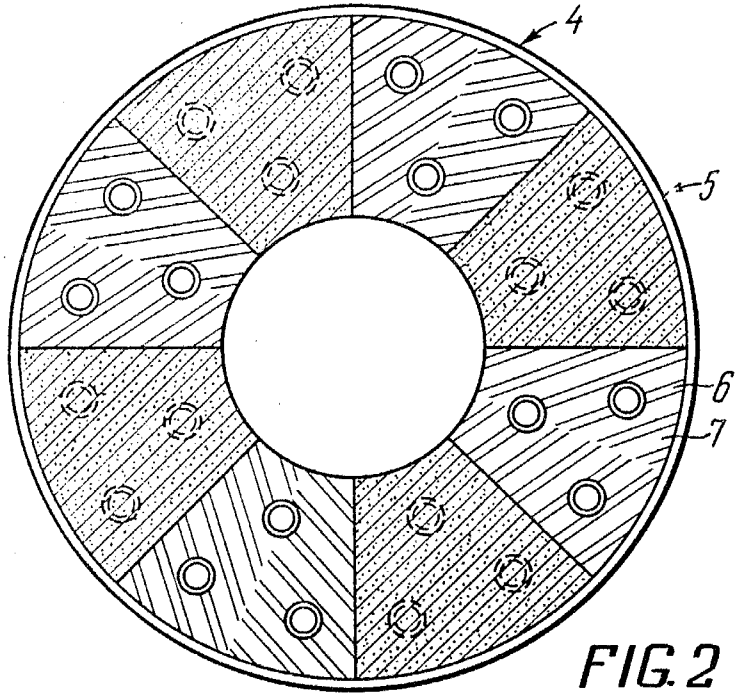
FIG. 2 is a refiner disc as viewed from a refining plate.
Figure 5:
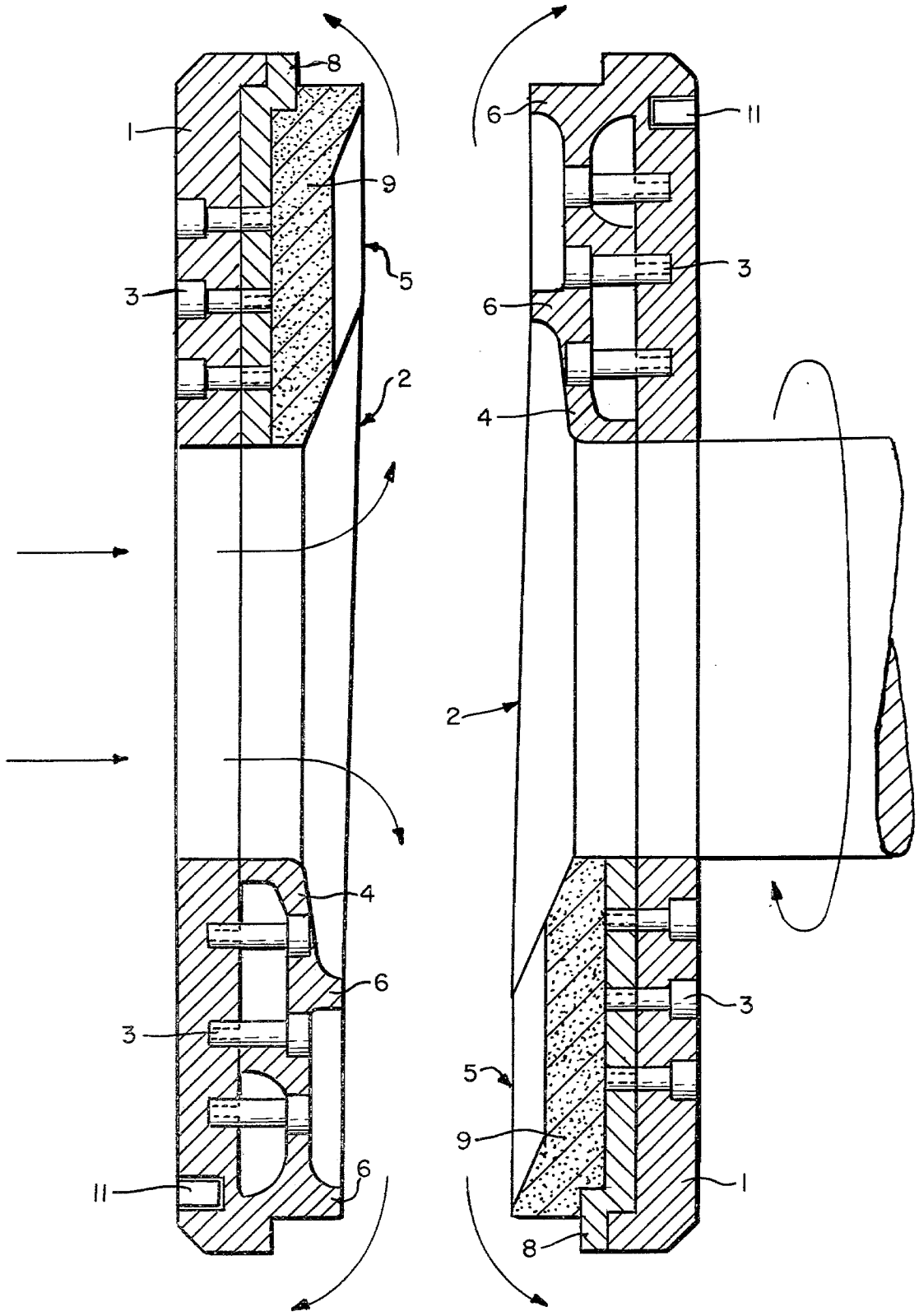
FIG. 5 is a cross-sectional view showing a pair of cooperational refiner discs.

FIGS. 3 and 4 show another embodiments of the refiner disc having the channels 10 disposed on the ceramic-based abrasive sectors 5.

The operation of the refining disc forming part of the refiner is as follows.

As mentioned hereinabove, the refiner comprises two discs arranged within the refiner housing, one of the discs being held stationary, while the other is rotatably mounted. It should be noted that the disc of the present invention is usable in combination with a similar disc as well as in combination with any disc known in the art.

The cellulosic pulp (not shown) is continuously fed between the adjacent surfaces of the disc refining plates (2) and then successively passes the alternatively arranged metallic and ceramic-based abrasive sectors 4,5, respectively.

The cellulosic pulp, while being brought into contact with various-type refining surfaces of the sectors (4,5), is alternately subjected to compressing and extending actions, resulting in intensive brushing of the fibres. Moreover, the grains of the ceramic-based abrasive material serve as micro-knives, thus beating the pulp without crushing and short-cutting the fibres.

It will be understood that the present invention is not restricted to the specific embodiments herein described and illustrated, and that various modifications and other embodiments of the proposed refiner disc may be made without departing from the scope and spirit of the appended claims.

It will be apparent to those skilled in the art that the channels disposed on the surfaces of the ceramic-based abrasive sectors can be not only rectangular in shape but may have any irregular shape.

What is claimed is:

1. In a paper pulp refiner wherein a pair of planar refining disks are juxtaposed, at least one of said disks rotating relative to the other, said one disk being a refiner rotor disk comprising a base supporting a combined metal-ceramic refining plate secured thereto, said metal-ceramic refining disk place having a plurality of metallic sectors and a plurality of alternately disposed abrasive sectors, said sectors being each bounded by radii converging toward the center of said plate, said metallic sectors and ceramic sectors having operating surfaces, the operating surfaces of said metallic sectors being level with the operating surface of the ceramic sectors and having rectangular channels depressed below said operating surface of said metallic sectors, said operating surface of said metallic sectors and channels defining a series of refining bars, said abrasive ceramic sectors having channels below the operating surface of said sectors; said metallic and ceramic sectors being disposed parallel to the disk plate, all of said metallic and ceramic sectors being fastened to said plate.

2. A refiner disk for the pulp refiner according to claim 1, wherein said ceramic-based abrasive sectors bounded by said radii have channels engraved on their operating surfaces at an angle to the radii defining said sector, said angle being selected within the range from near 0 to 90 degrees.

3. A refiner disk for the pulp refiner as defined in claim 2 wherein each metallic sector has at least two sets of channels angled relative to the plate radii of said metallic sector.

4. A refiner disk for the pulp refiner as defined in claim 1 wherein said ceramic sectors have channels engraved below their operating surfaces at an angle selected within the range from near 0 to 90 degrees, each metallic sector having at least two sets of channels, each set angled relative to the other and to the radii defining said metallic sector; said channels in said alternating sectors thus providing crushing, abrading and rolling functions for operating on pulp fibers.

* * * * *